US011085337B2

(12) United States Patent
Kinouchi et al.

(10) Patent No.: US 11,085,337 B2
(45) Date of Patent: Aug. 10, 2021

(54) VALVE TIMING ADJUSTMENT DEVICE

(71) Applicant: DENSO CORPORATION, Kariya (JP)

(72) Inventors: Soichi Kinouchi, Kariya (JP); Kenji Tada, Kariya (JP); Makoto Otsubo, Nisshin (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 16/775,599

(22) Filed: Jan. 29, 2020

(65) Prior Publication Data

US 2020/0248593 A1 Aug. 6, 2020

(30) Foreign Application Priority Data

Feb. 1, 2019 (JP) ..... JP2019-016681

(51) Int. Cl.
*F01L 1/344* (2006.01)
*F01L 1/02* (2006.01)
*F01L 1/047* (2006.01)

(52) U.S. Cl.
CPC ..... *F01L 1/344* (2013.01); *F01L 1/026* (2013.01); *F01L 1/047* (2013.01)

(58) Field of Classification Search
CPC ... F01L 1/344; F01L 1/352; F01L 1/46; F01L 2013/103; F01L 2800/16; F01L 2820/032
USPC ..... 123/90.15, 90.17
See application file for complete search history.

(56) References Cited

U.S. PATENT DOCUMENTS

2008/0083387 A1* 4/2008 Sugiura ..... F01L 1/352 123/90.17
2008/0083388 A1* 4/2008 Uehama ..... F01L 1/352 123/90.17
2009/0133650 A1* 5/2009 Mizutani ..... F01L 1/352 123/90.17
2010/0180845 A1* 7/2010 Kurisu ..... F01L 1/352 123/90.17
2016/0290181 A1* 10/2016 Otsubo ..... F01L 1/356
2017/0145873 A1* 5/2017 Pluta ..... F01L 1/352

FOREIGN PATENT DOCUMENTS

JP 2017-172656 9/2017
JP 2018-87564 6/2018
JP 2019-85910 6/2019
WO WO-2010018821 A1 * 2/2010 ..... F01L 1/344
WO WO-2010113747 A1 * 10/2010 ..... F01L 1/352

* cited by examiner

*Primary Examiner* — Jorge L Leon, Jr.
(74) *Attorney, Agent, or Firm* — Nixon & Vanderhye P.C.

(57) ABSTRACT

A valve timing adjustment device includes: a first rotatable body that is rotated about a rotational axis synchronously with one of a drive shaft and a driven shaft of an engine; and a second rotatable body that is rotated about the rotational axis synchronously with the other one of the drive shaft and the driven shaft. The first rotatable body includes: a fastening portion, a slide portion and a bearing portion. The fastening portion is fastened to the one of the drive shaft and the driven shaft. The bearing portion includes an outer peripheral surface that is opposed to an inner peripheral surface of the second rotatable body, and the bearing portion rotatably supports the second rotatable body. The fastening portion projects on one axial side of the slide portion and the bearing portion in an axial direction toward the one of the drive shaft and the driven shaft.

10 Claims, 4 Drawing Sheets

VALVE TIMING ADJUSTMENT DEVICE

CROSS REFERENCE TO RELATED APPLICATION

This application is based on and incorporates herein by reference Japanese Patent Application No. 2019-16681 filed on Feb. 1, 2019.

TECHNICAL FIELD

The present disclosure relates to a valve timing adjustment device.

BACKGROUND

Previously, there is proposed an electric valve timing adjustment device that is configured to adjust a valve timing of intake valves or exhaust valves of an internal combustion engine. This type of valve timing adjustment device may be used such that the valve timing adjustment device is fixed to an end portion of one of a drive shaft and a driven shaft.

SUMMARY

This section provides a general summary of the disclosure, and is not a comprehensive disclosure of its full scope or all of its features.

According to the present disclosure, there is provided a valve timing adjustment device that is configured to be fastened to an axial end portion of one of a drive shaft and a driven shaft of an internal combustion engine and is configured to be driven by an electric actuator to adjust a valve timing of a valve of the internal combustion engine by changing a rotational phase of the driven shaft relative to the drive shaft while the driven shaft is configured to be driven by the drive shaft to open and close the valve with a drive force transmitted from the drive shaft. The valve timing adjustment device includes: a first rotatable body that is configured to be rotated about a rotational axis synchronously with the one of the drive shaft and the driven shaft; and a second rotatable body that is configured to be rotated about the rotational axis synchronously with the other one of the drive shaft and the driven shaft. The first rotatable body includes a fastening portion that has a through-hole, which extends through the fastening portion in an axial direction. The fastening portion is fastened to the one of the drive shaft and the driven shaft with a bolt that is installed in the through-hole.

BRIEF DESCRIPTION OF DRAWINGS

The drawings described herein are for illustrative purposes only of selected embodiments and not all possible implementations, and are not intended to limit the scope of the present disclosure.

DETAILED DESCRIPTION

Figure 1:
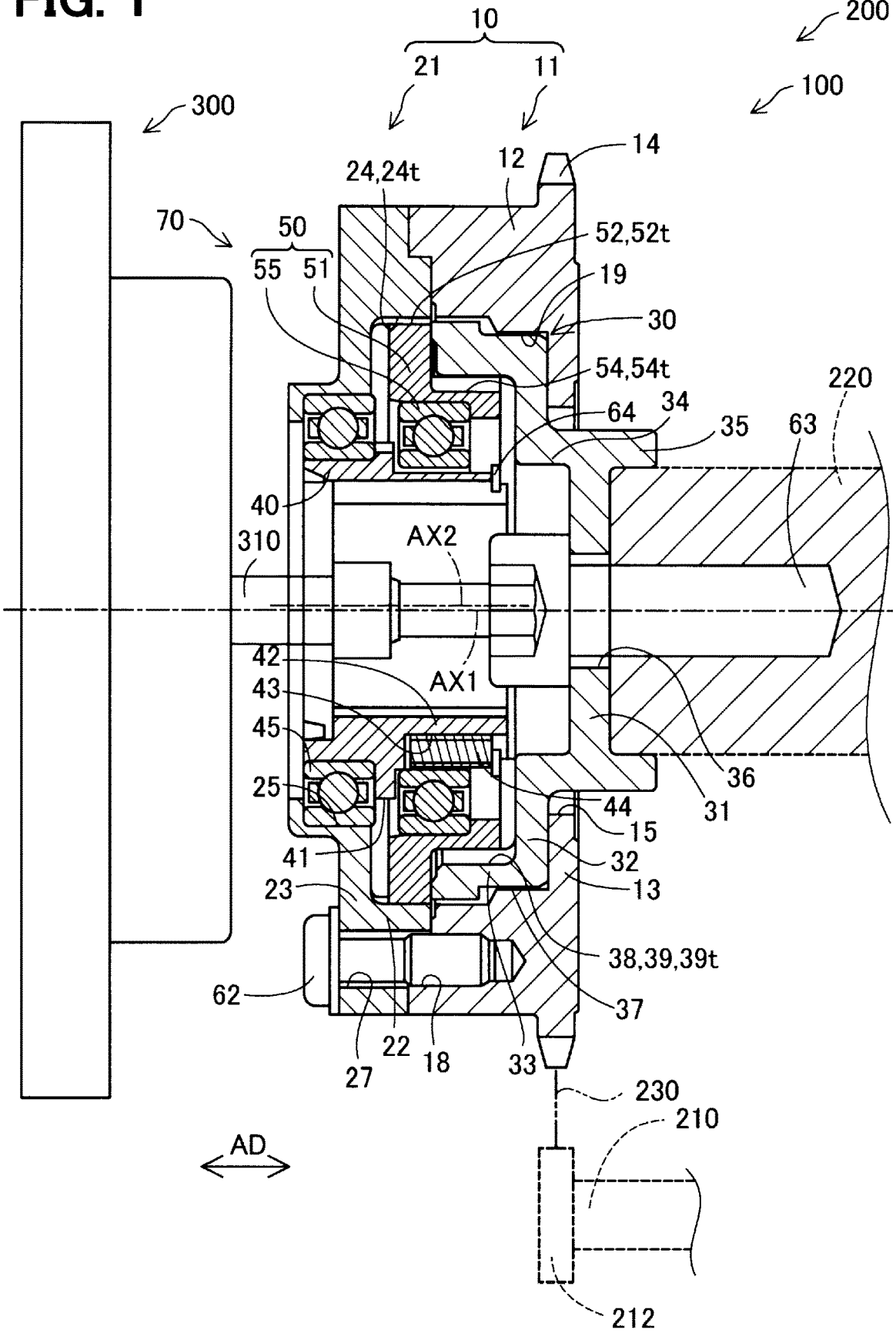
FIG. 1 is a cross-sectional view schematically showing a structure of a valve timing adjustment device.

Previously, there is proposed an electric valve timing adjustment device that is configured to adjust a valve timing of intake valves or exhaust valves of an internal combustion engine. This type of valve timing adjustment device may be used such that the valve timing adjustment device is fixed to an end portion of one of a drive shaft and a driven shaft. In this valve timing adjustment device, a driven-side rotatable body, which has an output gear, is fixed to an end portion of an intake camshaft with a bolt.

In the valve timing adjustment device described above, a surface of the driven-side rotatable body, which is configured to slide relative to a driving-side rotatable body, may possibly be deformed by an axial force generated at a time of fixing the driven-side rotatable body to the end portion of the intake camshaft by a bolt. Due to this deformation, the slidability between the driven-side rotatable body and the driving-side rotatable body may possibly be deteriorated. Therefore, there is a demand for a technique that can limit the deterioration in the slidability between the driven-side rotatable body and the driving-side rotatable body.

The present disclosure may be implemented in the following form.

According to an aspect of the present disclosure, there is provided a valve timing adjustment device. The valve timing adjustment device is configured to be fixed to an axial end portion of one of a drive shaft and a driven shaft of an internal combustion engine and is configured to be driven by an electric actuator to adjust a valve timing of a valve of the internal combustion engine by changing a rotational phase of the driven shaft relative to the drive shaft while the driven shaft is configured to be driven by the drive shaft to open and close the valve with a drive force transmitted from the drive shaft. The valve timing adjustment device includes: a first rotatable body that is configured to be rotated about a rotational axis synchronously with the one of the drive shaft and the driven shaft; and a second rotatable body that is configured to be rotated about the rotational axis synchronously with the other one of the drive shaft and the driven shaft. The first rotatable body includes: a fastening portion that has a through-hole, which extends through the fastening portion in the axial direction, wherein the fastening portion is fastened to the one of the drive shaft and the driven shaft with a bolt that is installed in the through-hole; a slide portion that includes a slide surface that extends in a direction, which crosses the axial direction, wherein the slide portion is configured to slide relative to the second rotatable body through the slide surface; and a bearing portion that is joined to an outer peripheral part of the slide portion and is located on an opposite axial side of the slide portion that is opposite to one axial side where the one of the drive shaft and the driven shaft is located in the axial direction. The bearing portion includes an outer peripheral surface that is opposed to an inner peripheral surface of the second rotatable body, and the bearing portion rotatably supports the second rotatable body. The fastening portion projects on the one axial side of the slide portion and the bearing portion in the axial direction.

In the valve timing adjustment device, the fastening portion of the driven-side rotatable body projects on the one axial side of the slide portion and the bearing portion in the axial direction. Therefore, in the case where the driven-side rotatable body is fixed to the one of the drive shaft and the driven shaft by the bolt installed in the through-hole of the fastening portion, and thereby the axial force is applied to the fastening portion, the influence of the deformation of the fastening portion onto the slide portion and the bearing portion can be limited, and thereby the deformation of the slide portion and the deformation of the bearing portion can be limited. Thus, the deterioration in the slidability between the slide surface of the driven-side rotatable body and the driving-side rotatable body can be limited, and the deterioration in the slidability between the outer peripheral surface of the bearing portion and the inner peripheral surface of the driving-side rotatable body can be limited. As a result, the deterioration in the slidability between the driven-side rotatable body and the driving-side rotatable body can be limited.

The present disclosure may be implemented in various forms. For example, the present disclosure may be implemented as a manufacturing method of the valve timing adjustment device, an internal combustion engine including the valve timing adjustment device and/or a vehicle having such an internal combustion engine.

Now, various embodiments of the present disclosure will be described with reference to the drawings.

A. First Embodiment

A valve timing adjustment device 100 of a first embodiment shown in FIG. 1 is configured to adjust a valve timing of a valve (not shown) that is opened and closed by a camshaft 220, to which a drive force is transmitted from a crankshaft 210, at an internal combustion engine 200 of a vehicle (not shown). The valve timing adjustment device 100 is fixed to an end portion of the camshaft 220 in a direction (hereinafter also referred to as an axial direction AD) that is along a rotational axis AX1 of the camshaft 220. Among intake valves and exhaust valves (not shown), which serve as valves, the valve timing adjustment device 100 of the present embodiment is configured to adjust a valve timing of the respective intake valves.

Figure 2:
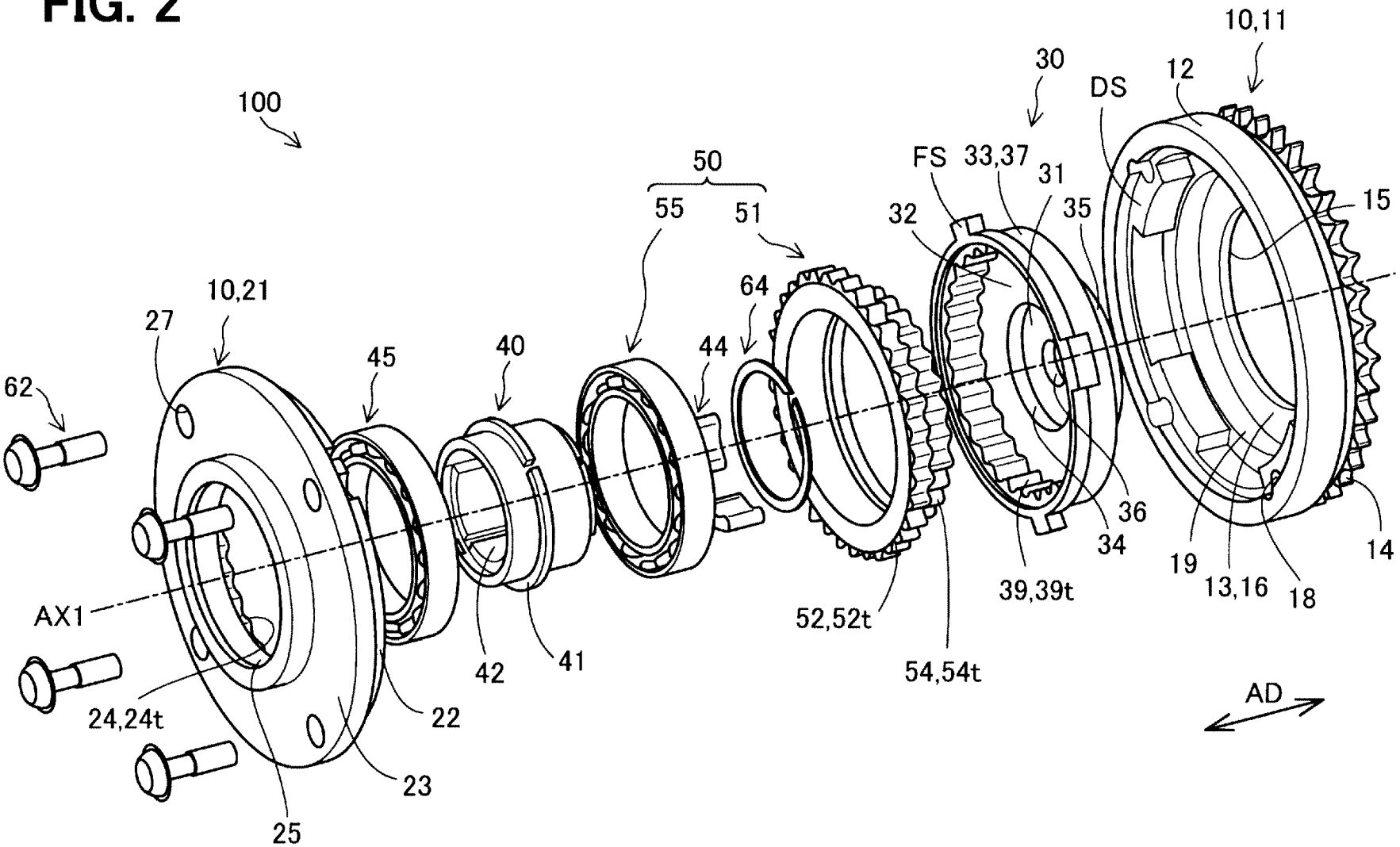
FIG. 2 is an exploded perspective view schematically showing the structure of the valve timing adjustment device.

As shown in FIGS. 1 and 2, the valve timing adjustment device 100 of the present embodiment includes a speed reducing mechanism known as a 2K—H type planetary gear mechanism and is driven by an electric motor 300. The valve timing adjustment device 100 includes a driving-side rotatable body 10, a driven-side rotatable body 30, an input rotatable body 40 and a planetary rotatable body 50.

The driving-side rotatable body 10 has a rotational axis AX1 that coincides with the rotational axis AX1 of the camshaft 220. The driving-side rotatable body 10 is configured to rotate synchronously with the crankshaft 210. The driving-side rotatable body 10 includes a first housing 11 and a second housing 21.

The first housing 11 is generally shaped in a tubular form having a bottom and includes a first cylindrical tubular portion 12 and a first bottom portion 13. An outside of the first cylindrical tubular portion 12 is generally shaped into a cylindrical form. A sprocket 14 is formed at an outer peripheral surface of the first cylindrical tubular portion 12. As shown in FIG. 1, a timing chain 230 is wound around the sprocket 14 and a sprocket 212 of the crankshaft 210. An engine torque of the crankshaft 210 is transmitted to the sprocket 14 through the timing chain 230, so that the first housing 11 is rotated synchronously with the crankshaft 210. Alternative to the timing chain 230, a timing belt may be used.

As shown in FIG. 1, a bearing portion 33 of the driven-side rotatable body 30 described later is placed on a radially inner side of the first cylindrical tubular portion 12. Therefore, an inner peripheral surface 19 of the first cylindrical tubular portion 12 is opposed to an outer peripheral surface 37 of the bearing portion 33. As shown in FIG. 2, the first cylindrical tubular portion 12 has a plurality of driving-side stoppers DS, which project radially inwardly and are arranged one after another in a circumferential direction. Each of a plurality of driven-side stoppers FS of the driven-side rotatable body 30 described later is placed between corresponding adjacent two of the driving-side stoppers DS in the circumferential direction. Each driving-side stopper DS has a bolt insertion hole 18. The bolt insertion holes 18 are used to fix the first housing 11 and the second housing 21 together. An insertion hole 15, which extends through the first bottom portion 13 in the axial direction AD, is formed at generally a center of the first bottom portion 13. As shown in FIG. 1, a connecting portion 34 of the driven-side rotatable body 30 described later is inserted through the insertion hole 15. The first bottom portion 13 has an inner surface 16 that is a surface of the first bottom portion 13 located on a side that is opposite to the camshaft 220 in the axial direction AD. The first bottom portion 13 slidably contacts a slide surface SS of the driven-side rotatable body 30 described later through the inner surface 16.

The second housing 21 is generally shaped in a tubular form having a bottom and includes a second cylindrical tubular portion 22 and a second bottom portion 23. As shown in FIG. 2, a driving-side internal gear portion 24 is formed at an inner peripheral surface of the second cylindrical tubular portion 22. The driving-side internal gear portion 24 includes a plurality of driving-side internal teeth **24*t*. As shown in FIG. 1, an axis of the driving-side internal gear portion 24 coincides with the rotational axis AX1. An opening portion 25 is formed generally at a center of the second bottom portion 23. The input rotatable body 40 is installed to the opening portion 25 through a first bearing 45. As shown in FIG. 2, a plurality of bolt insertion holes 27 is arranged one after another in the circumferential direction along an outer peripheral part of the second bottom portion 23. Each of a plurality of fastening bolts 62 is inserted through a corresponding one of the bolt insertion holes 27 of the second bottom portion 23 and a corresponding one of the bolt insertion holes 18 of the first housing 11. The first housing 11 and the second housing 21 are fastened together by the fastening bolts 62**.

As shown in FIG. 1, the driven-side rotatable body 30 is placed on the radially inner side of the first housing 11 such that the driven-side rotatable body 30 is rotatable relative to the driving-side rotatable body 10. The driven-side rotatable body 30 functions as an output component that outputs the torque inputted to the input rotatable body 40. An outside of the driven-side rotatable body 30 is shaped in a stepped cylindrical tubular form having a bottom. The driven-side rotatable body 30 includes a fastening portion 31, a slide portion 32, the bearing portion 33, the connecting portion 34 and an alignment portion 35.

Figure 3:
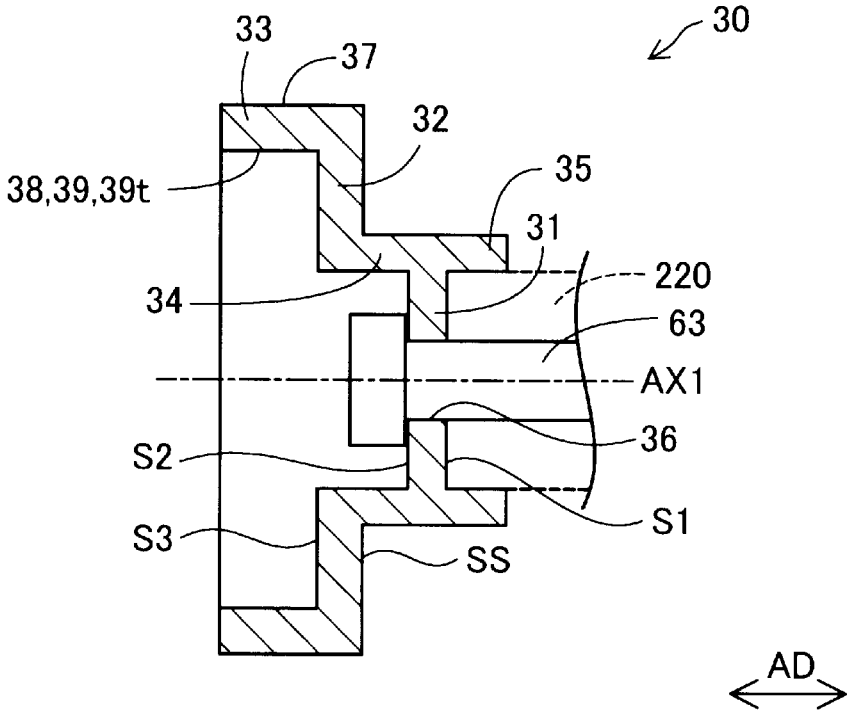
FIG. 3 is a cross-sectional view schematically showing a structure of a driven-side rotatable body.

As shown in FIGS. 1 and 3, the fastening portion 31 is generally shaped in a circular disk form and extends in a direction perpendicular to the axial direction AD. A through-hole 36 extends through the fastening portion 31 in the axial direction AD at a center of the fastening portion 31. The fastening portion 31 is fixed to the camshaft 220 by a bolt 63 that is installed through the through-hole 36. In this way, the driven-side rotatable body 30 is rotated synchronously with the camshaft 220. As described later, the fastening portion 31 projects on the camshaft 220 side of the slide portion 32 and the bearing portion 33 in the axial direction AD.

The slide portion 32 extends in a direction perpendicular to the axial direction AD. Therefore, the slide portion 32 extends in parallel with the fastening portion 31. As shown in FIG. 3, the slide portion 32 has the slide surface SS that is a surface of the slide portion 32 located on the camshaft 220 side in the axial direction AD. The slide portion 32 is slidable relative to the inner surface 16 of the first bottom portion 13 of the driving-side rotatable body 10 through the slide surface SS of the slide portion 32. Therefore, the slide surface SS functions as a thrust bearing surface.

The bearing portion 33 is joined to an outer peripheral part of the slide portion 32 and is formed on an opposite side of the slide portion 32, which is opposite to the camshaft 220 in the axial direction AD. The bearing portion 33 is shaped generally in a cylindrical tubular form that extends in the axial direction AD, and the bearing portion 33 is placed on the radially inner side of the first cylindrical tubular portion 12 of the driving-side rotatable body 10. The outer peripheral surface 37 of the bearing portion 33 is opposed to the inner peripheral surface 19 of the first cylindrical tubular portion 12 and is slidable relative to the inner peripheral surface 19 of the first cylindrical tubular portion 12. As shown in FIG. 2, the bearing portion 33 has the driven-side stoppers FS, which project radially outward and are arranged one after another in the circumferential direction. Each of the driven-side stoppers FS is placed between corresponding adjacent two of the driving-side stoppers DS in the circumferential direction. The driven-side stoppers FS and the driving-side stoppers DS limit rotational phase of the driven-side rotatable body 30 relative to the driving-side rotatable body 10. A driven-side internal gear part 39 is formed along an inner peripheral surface 38 of the bearing portion 33. The driven-side internal gear part 39 includes a plurality of driven-side internal teeth 39*t* that projects radially inwardly. An axis of the driven-side internal gear part 39 coincides with the rotational axis AX1.

The connecting portion 34 is shaped generally in a cylindrical tubular form. The connecting portion 34 is joined to both of the outer peripheral part of the fastening portion 31 and an inner peripheral part of the slide portion 32 and extends in parallel with the rotational axis AX1. The connecting portion 34 connects between the fastening portion 31 and the slide portion 32.

The alignment portion 35 projects from the outer peripheral part of the fastening portion 31 toward the camshaft 220 in the axial direction AD. The alignment portion 35 is installed to an outer peripheral surface of an end portion of the camshaft 220 and limits an axis deviation between the axis of the camshaft 220 and the axis of the valve timing adjustment device 100.

As shown in FIG. 3, in the present embodiment, a first end surface S1, which is an end surface of the fastening portion 31 located on the camshaft 220 side in the axial direction AD, is located on the camshaft 220 side of the slide surface SS in the axial direction AD, and a second end surface S2, which is another end surface of the fastening portion 31 located on the opposite side that is opposite to the camshaft 220 in the axial direction AD, is located on the camshaft 220 side of a third end surface S3, which is an end surface of the slide portion 32 located on the opposite side that is opposite to the camshaft 220 in the axial direction AD. Furthermore, the second end surface S2 is located on the camshaft 220 side of the slide surface SS in the axial direction AD and is located on the camshaft 220 side of the bearing portion 33 in the axial direction AD. A reason for having the above-described construction will be described later.

The input rotatable body 40 shown in FIGS. 1 and 2 is shaped generally in a cylindrical tubular form and functions as a carrier of the planetary rotatable body 50. As shown in FIG. 1, a shaft 310, which is a rotatable shaft of the electric motor 300, is inserted into and is fixed to an inside of the input rotatable body 40. The input rotatable body 40 is rotated integrally with the shaft 310 by a drive force of the electric motor 300. An axis of the shaft 310 of the electric motor 300 coincides with the rotational axis AX1 of the camshaft 220. A wall portion 41, which projects radially outward, is formed at an outer peripheral surface of the input rotatable body 40 at a location that is generally a center of the input rotatable body 40 in the axial direction AD. The first bearing 45 is placed on the electric motor 300 side of the wall portion 41 in the axial direction AD along the outer peripheral surface of the input rotatable body 40, and a second bearing 55 is placed on the camshaft 220 side of the wall portion 41 in the axial direction AD along the outer peripheral surface of the input rotatable body 40. The input rotatable body 40 is rotatably supported by the second housing 21 through the first bearing 45. Therefore, the input rotatable body 40 is configured such that the input rotatable body 40 is rotatable integrally with the shaft 310 and is rotatable relative to the driving-side rotatable body 10.

The input rotatable body 40 has an eccentric portion 42 that is eccentric to the rotational axis AX1. The eccentric portion 42 is formed by locally increasing a wall thickness of the input rotatable body 40 in the circumferential direction. A recess 43, which opens radially outward, is formed at an outer peripheral surface of the input rotatable body 40 such that the recess 43 is placed at the eccentric portion 42 side in the circumferential direction. Urging members (springs) 44 are received in the recess 43. The urging members 44 exert a restoring force and thereby urge the second bearing 55 toward the radially outer side at the eccentric portion 42. Therefore, the input rotatable body 40 supports the second bearing 55 while an eccentric axis AX2 serves as a central axis of the input rotatable body 40. A snap ring 64 is placed at an end surface of the respective urging members 44, which is located on the camshaft 220 side. The snap ring 64 limits removal of the urging members 44 from the recess 43 in the axial direction.

The planetary rotatable body 50 includes the second bearing 55 and a planetary gear 51. The second bearing 55 is installed to the inner peripheral surface of the planetary gear 51 and is supported by the input rotatable body 40 through the urging members 44, so that the second bearing 55 transmits the restoring force, which is received from the urging members 44, to the planetary gear 51. The planetary gear 51 is shaped in a stepped cylindrical tubular form and is rotatably supported by the second bearing 55 such that the planetary gear 51 is rotatable about the eccentric axis AX2, which serves as a central axis of the planetary gear 51. As shown in FIG. 2, the planetary gear 51 includes a driving-side external gear part 52 and a driven-side external gear part 54. A pitch circle diameter of the driving-side external gear part 52 is larger than a pitch circle diameter of the driven-side external gear part 54.

The driving-side external gear part 52 includes a plurality of driving-side external teeth 52*t* that project radially outward. The driving-side external teeth 52*t* are meshed with the driving-side internal teeth 24*t* of the driving-side internal gear portion 24. The driven-side external gear part 54 includes a plurality of driven-side external teeth 54*t* that project radially outward. The driven-side external teeth 54*t* are meshed with the driven-side internal teeth 39*t* of the driven-side internal gear part 39. The number of the driving-side external teeth 52*t* is smaller than the number of the driving-side internal teeth 24*t* by one. Also, the number of the driven-side external teeth 54*t* is smaller than the number of the driven-side internal teeth 39*t* by one.

When the input rotatable body 40 is rotated about the rotational axis AX1, which serves as the central axis of the input rotatable body 40, the planetary rotatable body 50 shown in FIG. 1 makes a planetary motion, i.e., the planetary rotatable body 50 is rotated about the eccentric axis AX2 serving as the central axis of the planetary rotatable body 50 and revolves around the rotational axis AX1. A rotational speed of the planetary rotatable body 50 is reduced relative to the rotational speed of the input rotatable body 40. The driven-side internal gear part 39 and the driven-side external gear part 54 function as a transmitting means for transmitting the rotation of the planetary rotatable body 50 to the driven-side rotatable body 30.

The valve timing adjustment device 100, which has the above-described structure, transmits the rotation of the input rotatable body 40 to the driven-side rotatable body 30 while reducing the rotational speed of the rotation received from the input rotatable body 40, and the valve timing adjustment device 100 changes a rotational phase of the driven-side rotatable body 30 relative to the driving-side rotatable body 10. Thereby, the valve timing, which corresponds to this rotational phase, is achieved.

In a case where the rotational speed of the input rotatable body 40 is the same as the rotational speed of the driving-side rotatable body 10, the input rotatable body 40 does not rotate relative to the driving-side internal gear portion 24 formed at the driving-side rotatable body 10. Therefore, the planetary rotatable body 50 does not make the planetary motion and is rotated along with the driving-side rotatable body 10 and the driven-side rotatable body 30. As a result, the rotational phase of the driven-side rotatable body 30 relative to the driving-side rotatable body 10 does not change, and thereby the current valve timing is maintained.

In contrast, in a case where the rotational speed of the input rotatable body 40 is lower than the rotational speed of the driving-side rotatable body 10, the input rotatable body 40 is rotated relative to the driving-side internal gear portion 24 toward the advancing side, and the planetary rotatable body 50 makes the planetary motion. As a result, the driven-side rotatable body 30 is rotated relative to the driving-side rotatable body 10 toward the advancing side, and thereby the valve timing is advanced. Furthermore, in a case where the rotational speed of the input rotatable body 40 is lower than the rotational speed of the driving-side rotatable body 10, or in a case where the rotational direction of the input rotatable body 40 is opposite to the rotational direction of the driving-side rotatable body 10, the input rotatable body 40 is rotated relative to the driving-side internal gear portion 24 toward the retarding side, and the planetary rotatable body 50 makes the planetary motion. As a result, the driven-side rotatable body 30 is rotated relative to the driving-side rotatable body 10 toward the retarding side, and thereby the valve timing is retarded.

Figure 4:
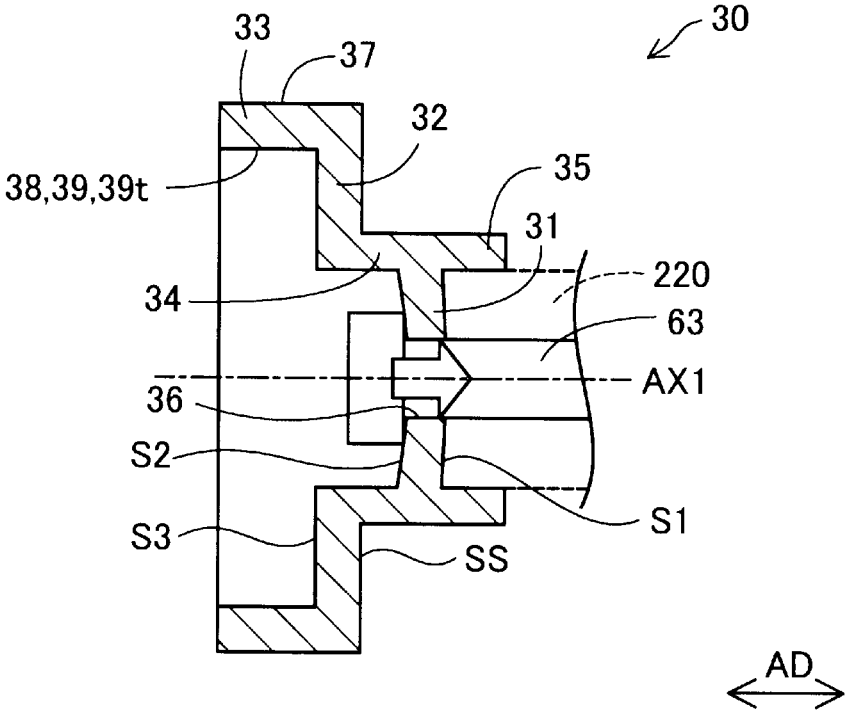
FIG. 4 is a descriptive view for describing deformation of a driven-side rotatable body caused by fastening with a bolt.

As described above, the driven-side rotatable body 30 is fixed to the camshaft 220 by the bolt 63 that is placed in the through-hole 36 of the fastening portion 31. Therefore, when an axial force indicated by a blank arrow in FIG. 4 is applied through the fastening of the bolt 63, the fastening portion 31 is slightly distorted and deformed.

Here, in the driven-side rotatable body 30 of the present embodiment, the fastening portion 31 projects on the camshaft 220 side of the slide portion 32 and the bearing portion 33 in the axial direction AD. More specifically, the first end surface S1 of the fastening portion 31 is located on the camshaft 220 side of the slide surface SS, and the second end surface S2 of the fastening portion 31 is located on the camshaft 220 side of the third end surface S3 of the slide portion 32. With this construction, the influence of the deformation of the fastening portion 31 onto the slide portion 32 and the bearing portion 33 is limited, and thereby deformation of the slide portion 32 and deformation of the bearing portion 33 are limited. Thus, a deterioration in the slidability between the slide surface SS of the driven-side rotatable body 30 and the first bottom portion 13 of the driving-side rotatable body 10 can be limited, and a deterioration in the slidability between the outer peripheral surface 37 of the driven-side rotatable body 30 and the inner peripheral surface 19 of the driving-side rotatable body 10 can be limited. Therefore, a deterioration in the slidability between the driven-side rotatable body 30 and the driving-side rotatable body 10 can be limited. Furthermore, since the second end surface S2 is located on the camshaft 220 side of the slide surface SS and the bearing portion 33, the influence of the deformation of the fastening portion 31 onto the slide portion 32 and the bearing portion 33 is further limited. Therefore, the deformation of the slide portion 32 and the deformation of the bearing portion 33 are further limited.

In the present embodiment, the crankshaft 210 may be a subordinate concept (more specific concept) of the drive shaft and the other shaft of the present disclosure, and the camshaft 220 may be a subordinate concept of the driven shaft and the one shaft of the present disclosure. Furthermore, the electric motor 300 may be a subordinate concept of an electric actuator of the present disclosure, and the intake valve may be a subordinate concept of the valve of the present disclosure. Furthermore, the driven-side rotatable body 30 may serve a first rotatable body of the present disclosure, and the driving-side rotatable body 10 may serve as a second rotatable body of the present disclosure. Furthermore, the driven-side internal teeth 39*t* may be a subordinate concept of the internal teeth of the present disclosure.

In the valve timing adjustment device 100 of the first embodiment described above, the fastening portion 31 of the driven-side rotatable body 30 projects on the camshaft 220 side of the slide portion 32 and the bearing portion 33 in the axial direction AD. Therefore, in the case where the driven-side rotatable body 30 is fixed to the camshaft 220 by the bolt 63 installed in the through-hole 36 of the fastening portion 31, and thereby the axial force is applied to the fastening portion 31, the influence of the deformation of the fastening portion 31 onto the slide portion 32 and the bearing portion 33 can be limited, and thereby the deformation of the slide portion 32 and the deformation of the bearing portion 33 can be limited. Thus, the deterioration in the slidability between the slide surface SS of the driven-side rotatable body 30 and the first bottom portion 13 of the driving-side rotatable body 10 can be limited, and the deterioration in the slidability between the outer peripheral surface 37 of the bearing portion 33 and the inner peripheral surface 19 of the driving-side rotatable body 10 can be limited. Therefore, the deterioration in the slidability between the driven-side rotatable body 30 and the driving-side rotatable body 10 can be limited.

Furthermore, the deterioration in the slidability between the driven-side rotatable body 30 and the driving-side rotatable body 10 can be limited, so that an increase in a friction caused by the sliding between the driven-side rotatable body 30 and the driving-side rotatable body 10 can be limited, and thereby deterioration in wear resistance can be limited.

Furthermore, the first end surface S1 of the fastening portion 31 is located on the camshaft 220 side of the slide surface SS, and the second end surface S2 of the fastening portion 31 is located on the camshaft 220 side of the third end surface S3 of the slide portion 32, so that the influence of the deformation of the fastening portion 31 on the slide portion 32 and the bearing portion 33 can be limited, and thereby the deformation of the slide portion 32 and the deformation of the bearing portion 33 can be limited.

Furthermore, the second end surface S2 is located on the camshaft 220 side of the slide surface SS, so that the influence of the deformation of the fastening portion 31 onto the slide portion 32 can be further limited, and thereby the deformation of the slide portion 32 can be further limited. Therefore, the deterioration in the slidability between the slide surface SS of the driven-side rotatable body 30 and the first bottom portion 13 of the driving-side rotatable body 10 can be further limited. Furthermore, the second end surface S2 is located on the camshaft 220 side of the bearing portion 33, so that the influence of the deformation of the fastening portion 31 onto the bearing portion 33 can be further limited, and thereby the deformation of the bearing portion 33 can be further limited. Therefore, the deterioration in the slidability between the outer peripheral surface 37 of the driven-side rotatable body 30 and the inner peripheral surface 19 of the driving-side rotatable body 10 can be further limited.

Furthermore, the connecting portion 34, which connects between the fastening portion 31 and the slide portion 32, extends in parallel with the rotational axis AX1, so that the complication and the size increase of the structure of the valve timing adjustment device 100 can be limited. Furthermore, the fastening portion 31 and the slide portion 32 extend in parallel with each other, so that the complication and the size increase of the structure of the valve timing adjustment device 100 can be limited.

Furthermore, the valve timing adjustment device 100 includes the 2K—H type planetary gear mechanism, so that the driven-side internal teeth 39*t* of the driven-side internal gear part 39 are formed at the inner peripheral surface 38 of the bearing portion 33 of the driven-side rotatable body 30. With the above described structure, the influence of the deformation of the fastening portion 31 onto the bearing portion 33 is limited, and thereby the inclination of the meshed parts between the driven-side internal teeth 39*t* and the driven-side external teeth 54*t* can be limited. Therefore, the deterioration in the reliability of the valve timing adjustment device 100 can be limited. Furthermore, the wearing between the driven-side internal teeth 39*t* and the driven-side external teeth 54*t* can be limited.

B. Comparative Example

Figure 5:
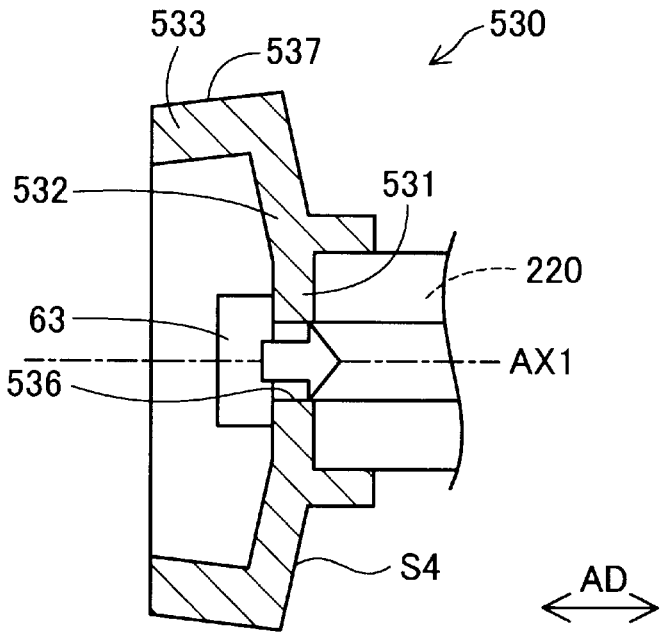
FIG. 5 RELATED ART
FIG. 5 is a descriptive view for describing deformation of a driven-side rotatable body caused by fastening with a bolt in a comparative example.

FIG. 5 shows a driven-side rotatable body 530 of a valve timing adjustment device of a comparative example in a deformed state where the driven-side rotatable body 530 is deformed by application of an axial force indicated by a blank arrow to the fastening portion 531 through fastening of the bolt 63 relative to the camshaft 220. In the driven-side rotatable body 530 before the time of occurrence of the deformation of the driven-side rotatable body 530, a location of the fastening portion 531 in the axial direction AD coincides with a location of the slide portion 532 in the axial direction AD. In other words, a surface of the fastening portion 531, which is located on the camshaft 220 side in the axial direction AD, and a surface of the slide portion 532, which is located on the camshaft 220 side in the axial direction AD, are located along a common plane, and an opposite surface of the fastening portion 531, which is located on the opposite side that is opposite to the camshaft 220 in the axial direction AD, and an opposite surface of the slide portion 532, which is located on the opposite side that is opposite to the camshaft 220 in the axial direction AD, are located along a common plane. At the time of assembly, when the driven-side rotatable body 530 is fixed to the camshaft 220 by the bolt 63 installed in the through-hole 536 of the fastening portion 531, and thereby the axial force is applied to the fastening portion 531 as indicated by the blank arrow in FIG. 5, the deformation of the fastening portion 531 has the influence on the slide portion 532. More specifically, the slide portion 532 is progressively distorted from the inner peripheral part of the slide portion 532 toward the outer peripheral part of the slide portion 532 such that the slide portion 532 is distorted toward the opposite side that is opposite to the camshaft 220 in the axial direction AD. Furthermore, the deformation of the slide portion 532 has the influence on the bearing portion 533. More specifically, the bearing portion 533 is progressively distorted from the camshaft 220 side of the bearing portion 533 toward the opposite side, which is opposite to the camshaft 220, such that the bearing portion 533 is distorted toward the radially inner side. When the slide portion 532 is deformed, slidability between a slide surface S4 of the driven-side rotatable body 530 and the driving-side rotatable body is deteriorated. Furthermore, when the bearing portion 533 is deformed, slidability between the outer peripheral surface 537 of the bearing portion 533 of the driven-side rotatable body 530 and the driving-side rotatable body 10 is deteriorated. Therefore, the slidability between the driven-side rotatable body 530 and the driving-side rotatable body is deteriorated.

In contrast, in the valve timing adjustment device 100 of the present embodiment, the fastening portion 31 of the driven-side rotatable body 30 projects on the camshaft 220 side of the slide portion 32 and the bearing portion 33 in the axial direction AD. Therefore, in the case where the driven-side rotatable body 30 is fixed to the camshaft 220 by the bolt 63 installed in the through-hole 36 of the fastening portion 31, and thereby the axial force is applied to the fastening portion 31, the influence of the deformation of the fastening portion 31 onto the slide portion 32 and the bearing portion 33 can be limited, and thereby the deformation of the slide portion 32 and the deformation of the bearing portion 33 can be limited. Therefore, a deterioration in the slidability between the driven-side rotatable body 30 and the driving-side rotatable body 10 can be limited.

C. Second Embodiment

Figure 6:
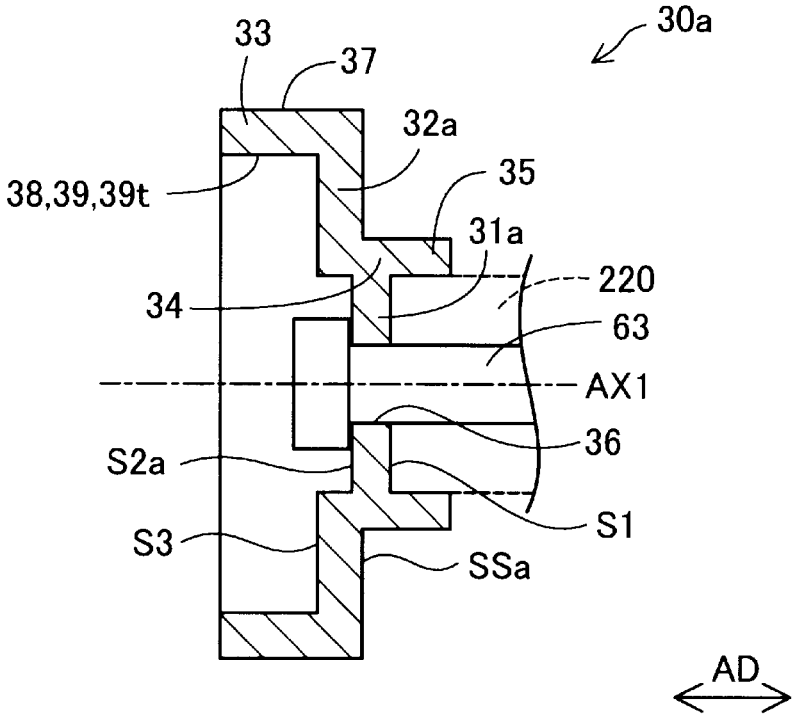
FIG. 6 is a cross-sectional view schematically showing a structure of a driven-side rotatable body according to a second embodiment.

A driven-side rotatable body 30*a* of a valve timing adjustment device of a second embodiment shown in FIG. 6 differs from the valve timing adjustment device 100 of the first embodiment with respect to elimination of the connecting portion 34 and the positional relationship between the second end surface S2*a* and the slide surface SSa. Since the rest of the structure is the same as that of the first embodiment, the same structural parts, which are the same as those of the first embodiment, are indicated by the same reference signs and will not be descried in detail.

The slide surface SSa of the driven-side rotatable body 30*a* of the valve timing adjustment device of the second embodiment is located on the camshaft 220 side of the second end surface S2*a* in the axial direction AD. With this structure, the fastening portion 31*a* of the driven-side rotatable body 30*a* projects on the camshaft 220 side of the slide portion 32*a* and the bearing portion 33 in the axial direction AD.

The valve timing adjustment device of the second embodiment described above achieves the same advantages as those of the valve timing adjustment device 100 of the first embodiment.

D. Other Embodiments (1) The structure of the driven-side rotatable body 30, 30*a* of each of the above embodiments is merely the example and may be modified in various ways. For instance, the connecting portion 34 is not necessarily parallel with the rotational axis AX1. For example, the connecting portion 34 may be in a tapered form where the rotational axis AX1 serves as an axis of the tapered form. Furthermore, the slide portion 32, 32*a* is not necessarily parallel with the fastening portion 31, 31*a*. For example, the slide portion 32, 32*a* may extend in any direction that intersects the axial direction AD such that the slide portion 32, 32*a* slides relative to the first bottom portion 13 of the driving-side rotatable body 10, which extends in the extending direction of the slide portion 32, 32*a*. Furthermore, the alignment portion 35 may be eliminated. Even with the above structure(s), the advantages, which are the same as those of the respective embodiments described above, can be achieved.

(2) In each of the above embodiments, the valve timing adjustment device 100 includes the 2K—H type planetary gear mechanism. However, the type of planetary gear mechanism should not be limited to the 2K—H type. For example, the valve timing adjustment device 100 may include a K—H—V type planetary gear mechanism or a 3K type planetary gear mechanism. In such a case, the driven-side internal teeth 39*t* may not be formed at the inner peripheral surface 38 of the bearing portion 33 of the driven-side rotatable body 30, 30*a*. Furthermore, in place of the planetary gear mechanism, the valve timing adjustment device 100 may include: a strain wave gear mechanism, which has a strain wave gear; or a roller mechanism, which has rollers and a retainer. Even with the above structure(s), the advantages, which are the same as those of the respective embodiments described above, can be achieved.

(3) In each of the above embodiments, the valve timing adjustment device 100 adjusts the valve timing of the intake valves that are opened and closed by the camshaft 220. Alternatively, in place of the intake valves, the valve timing adjustment device 100 may adjust a valve timing of exhaust valves, which are opened and closed by the camshaft 220. Furthermore, in each of the above embodiments, the valve timing adjustment device 100 changes the rotational phase of the camshaft 220 relative to the crankshaft 210 by the drive force of the electric motor 300. However, the present disclosure should not be limited to the electric motor 300. For instance, the rotational phase may be changed by a drive force of any electric actuator, such as a brake type actuator. Furthermore, the valve timing adjustment device 100 may be fixed to an end portion of the camshaft 220 that is a driven shaft, to which a drive force is transmitted from the crankshaft 210 (serving as the drive shaft) through an intermediate shaft. Further alternatively, the valve timing adjustment device 100 may be fixed to an end portion of the crankshaft 210 in place of the camshaft 220. Further alternatively, the valve timing adjustment device 100 may be fixed to an end portion of one of a drive shaft and a driven shaft of a dual camshaft structure.

The present disclosure should not be limited to each of the above embodiments and may be implemented in various types of structures within a scope of the present disclosure. For example, one or more of the technical features of each of the above embodiments, which correspond to the technical features of the example recited in the summary of the invention, may be appropriately replaced or combined to address a portion or all of the objective(s) described above or to achieve a portion of all of the advantages described above. Furthermore, one or more of the technical features may be appropriately eliminated unless the one or more of the technical features are described as indispensable technical feature(s).

What is claimed is:

1. A valve timing adjustment device that is configured to be fastened to an axial end portion of one of a drive shaft and a driven shaft of an internal combustion engine and is configured to be driven by an electric actuator to adjust a valve timing of a valve of the internal combustion engine by changing a rotational phase of the driven shaft relative to the drive shaft while the driven shaft is configured to be driven by the drive shaft to open and close the valve with a drive force transmitted from the drive shaft, the valve timing adjustment device comprising:

a first rotatable body that is configured to be rotated about a rotational axis of the one of the drive shaft and the driven shaft synchronously with the one of the drive shaft and the driven shaft; and a second rotatable body that is configured to be rotated about the rotational axis synchronously with a remaining one of the drive shaft and the driven shaft, wherein:

the first rotatable body includes:

a fastening portion that has a through-hole, which extends through the fastening portion in an axial direction of the one of the drive shaft and the driven shaft, wherein the fastening portion is fastened to the one of the drive shaft and the driven shaft with a bolt that is installed in the through-hole;

a slide portion that includes a slide surface that extends in a direction perpendicular to the rotational axis, wherein the slide portion is configured to slide relative to the second rotatable body through the slide surface; and a radial bearing portion formed at the first rotatable body and is located at a predetermined radial location while the radial bearing portion is joined to an outer peripheral part of the slide portion and is located entirely on an opposite axial side of the slide portion that is opposite to one axial side where the one of the drive shaft and the driven shaft is located in the axial direction, wherein the radial bearing portion includes an outer peripheral surface that is opposed to and slidably contacts an inner peripheral surface of the second rotatable body, and the radial bearing portion rotatably supports the second rotatable body;

the fastening portion projects on the one axial side of the slide portion and the radial bearing portion in the axial direction; and the one of the drive shaft and the driven shaft is entirely displaced away from the second rotatable body in the axial direction such that the one of the drive shaft and the driven shaft is entirely on an axial side of a first end surface of the fastening portion and the second rotatable body is entirely on an opposite axial side of the first end surface of the fastening portion, and the first end surface is an end surface of the fastening portion located on the one axial side in the axial direction and contacts the one of the drive shaft and the driven shaft.

2. The valve timing adjustment device according to claim 1, wherein:

first end surface, which is the end surface of the fastening portion located on the one axial side in the axial direction, is located on the one axial side of the slide surface in the axial direction; and a second end surface, which is another end surface of the fastening portion located on the opposite axial side that is opposite to the one axial side in the axial direction, is located on the one axial side of a third end surface that is an end surface of the slide portion located on the opposite axial side that is opposite to the one axial side in the axial direction.

3. The valve timing adjustment device according to claim 2, wherein the second end surface is located on the one axial side of the slide surface in the axial direction.

4. The valve timing adjustment device according to claim 2, wherein the second end surface is located on the one axial side of the radial bearing portion in the axial direction.

5. The valve timing adjustment device according to claim 1, further comprising a connecting wall that is parallel with the rotational axis and connects between the fastening portion and the slide portion.

6. The valve timing adjustment device according to claim 1, wherein the fastening portion and the slide portion are parallel to each other.

7. The valve timing adjustment device according to claim 1, wherein a plurality of internal teeth is formed at an inner peripheral surface of the radial bearing portion.

8. The valve timing adjustment device according to claim 1, wherein the fastening portion is opposed to and contacts an axial end of the one of the drive shaft and the driven shaft in the axial direction.

9. The valve timing adjustment device according to claim 1, wherein:

the first rotatable body further includes an alignment portion projecting from the fastening portion toward the one of the of drive shaft and the driven shaft in the axial direction; and the alignment portion includes an inner peripheral surface contacting an outer peripheral surface of the one of the drive shaft and the driven shaft.

10. The valve timing adjustment device according to claim 1, wherein an adjacent portion of the second rotatable body, which is placed adjacent to the slide surface of the slide portion on the one axial side of the slide surface of the slide portion in the axial direction and is directly opposed to the first rotatable body in a radial direction of the second rotatable body, is entirely spaced away from the first rotatable body in the radial direction by a radial gap formed between the adjacent portion of the second rotatable body and the first rotatable body.

* * * * *